US011158231B2

(12) United States Patent
Kang

(10) Patent No.: US 11,158,231 B2
(45) Date of Patent: Oct. 26, 2021

(54) DRIVING METHOD FOR DISPLAY PANEL, AND DEVICE

(71) Applicants: HKC CORPORATION LIMITED, Shenzhen (CN); CHONGQING HKC OPTOELECTRONICS TECHNOLOGY CO., LTD., Chongqing (CN)

(72) Inventor: Chih Tsung Kang, Chongqing (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 16/771,694

(22) PCT Filed: Aug. 16, 2018

(86) PCT No.: PCT/CN2018/100771

§ 371 (c)(1),
(2) Date: Jun. 11, 2020

(87) PCT Pub. No.: WO2019/137004

PCT Pub. Date: Jul. 18, 2019

(65) Prior Publication Data

US 2021/0074199 A1 Mar. 11, 2021

(30) Foreign Application Priority Data

Jan. 10, 2018 (CN) ..... 201810022939.6

(51) Int. Cl.
*G09G 3/20* (2006.01)

(52) U.S. Cl.
CPC ... *G09G 3/2003* (2013.01); *G09G 2300/0452* (2013.01); *G09G 2320/0276* (2013.01); *G09G 2320/0673* (2013.01)

(58) Field of Classification Search
CPC ..... G09G 3/2003; G09G 2300/0452; G09G 2320/0276; G09G 2320/0673
See application file for complete search history.

(56) References Cited

U.S. PATENT DOCUMENTS 10,621,931 B2 * 4/2020 Kang ..... G09G 3/3413
10,629,144 B2 * 4/2020 Kang ..... G09G 3/3406
(Continued)

FOREIGN PATENT DOCUMENTS

CN 103106884 A 5/2013
CN 103489400 A 1/2014
(Continued)

*Primary Examiner* — Kenneth Bukowski
(74) *Attorney, Agent, or Firm* — Kilpatrick Townsend & Stockton

(57) ABSTRACT

This application relates to a drive method of a display panel. The method includes dividing sub pixels of the same color on the display panel into a plurality of sub pixel groups, acquiring a difference curve that is of each color sub pixel and that is between a curve of brightness changing with a drive voltage at a front view angle and a curve of brightness changing with the drive voltage at a side view angle, and for each color sub pixel, respectively regulating gamma values of various sub pixel groups based on the difference curve.

17 Claims, 8 Drawing Sheets

(56) References Cited

U.S. PATENT DOCUMENTS

| | | | | |
|---|---|---|---|---|
| 2005/0200580 | A1* | 9/2005 | Li | G09G 3/3607 345/88 |
| 2017/0110064 | A1* | 4/2017 | Zhang | G09G 3/2018 |
| 2017/0154587 | A1* | 6/2017 | Chen | G09G 3/3607 |
| 2017/0330520 | A1* | 11/2017 | Tien | G09G 3/3648 |

FOREIGN PATENT DOCUMENTS

| | | | |
|---|---|---|---|
| CN | 105388649 | A | 3/2016 |
| CN | 106683627 | A | 5/2017 |
| CN | 106782371 | A | 5/2017 |
| CN | 106842724 | A | 6/2017 |
| CN | 108320716 | A | 7/2018 |
| CN | 108335678 | A | 7/2018 |
| JP | 4650845 | B2 | 3/2011 |
| WO | 2013075364 | A1 | 5/2013 |

* cited by examiner

DRIVING METHOD FOR DISPLAY PANEL, AND DEVICE

CROSS REFERENCE TO RELATED APPLICATIONS

This application claims priority to Chinese Patent Application No. 2018100229396, entitled "DISPLAY METHOD AND DEVICE OF DISPLAY PANEL", filed with the Chinese Patent Office on Jan. 10, 2018, and the entire content of which is incorporated herein in its entirety.

FIELD

This application relates to the technical field of display, and more particularly relates to a drive method and device of a display panel.

BACKGROUND

An exemplary large-size liquid crystal display panel generally adopts a negative VA (Vertical Alignment) liquid crystal or IPS (In-Plane Switching) liquid crystal technology. The VA type liquid crystal technology has advantages of high production efficiency and low manufacturing costs compared with the IPS liquid crystal technology; however, its optical property has obvious defects compared with the IPS liquid crystal technology, especially under a condition that the large-size panel needs relatively large view angle presentation in an aspect of commercial application.

For the exemplary VA type liquid crystal panel, a trend that brightness of various sub pixels at a side view angle becomes saturated (that is, a curve tends to be flat) is rapidly increased. Especially under intermediate and low drive voltages, the brightness is rapidly saturated, and a contrast is decreased, so that an obvious washout phenomenon (that is, a picture is partial white, and the brightness cannot linearly change with the drive voltage) appears when a picture is watched at a mixed view angle. In order to resolve the above problem, an exemplary solution generally is increasing a gamma value. However, after the gamma value is increased, although the brightness contrast of the intermediate and low drive voltages at a side view angle can be improved, a contrast of brightness changing with the drive voltage at a front view angle and a brightness contrast of the high drive voltage at a side view angle are sacrificed, and an entire display effect of the display panel is still reduced.

SUMMARY

Accordingly, it is necessary to provide a drive method and device of a display panel as to a problem that the entire display effect of the display panel is still reduced in an exemplary manner of increasing a gamma value.

A drive method of a display panel includes:

dividing sub pixels of the same color on the display panel into a plurality of sub pixel groups;

acquiring a difference curve that is of each color sub pixel and that is between a curve of brightness changing with a drive voltage at a front view angle and a curve of brightness changing with the drive voltage at a side view angle; and for each color sub pixel, respectively regulating gamma values of various sub pixel groups based on the difference curve.

A drive device of a display panel includes:

a pixel division module, used to divide sub pixels of the same color on the display panel into a plurality of sub pixel groups;

a difference curve acquiring module, used to acquire a difference curve that is of each color sub pixel and that is between a curve of brightness changing with a drive voltage at a front view angle and a curve of brightness changing with the drive voltage at a side view angle; and a gamma value regulation module, used to, for each color sub pixel, respectively regulate gamma values of various sub pixel groups based on the difference curve.

A drive method of a display panel includes:

dividing sub pixels of the same color on the display panel into a plurality of sub pixel groups;

acquiring a difference curve that is of each color sub pixel and that is between a curve of brightness changing with a drive voltage at a front view angle and a curve of brightness changing with the drive voltage at a side view angle;

for each color sub pixel, setting different drive voltage intervals based on the difference curve and setting a set gamma value corresponding to each drive voltage interval, acquiring the drive voltage interval having a maximum quantity of drive voltages distributed in the sub pixel group, and setting the set gamma value corresponding to the acquired drive voltage interval as a gamma value corresponding to the sub pixel group; and for each color sub pixel, filtering regulated gamma values of various sub pixel groups.

In the foregoing drive method and device of a display panel, sub pixels of the same color on the display panel are divided into a plurality of sub pixel groups; a difference curve that is of each color sub pixel and that is between a curve of brightness changing with a drive voltage at a front view angle and a curve of brightness changing with the drive voltage at a side view angle is acquired; and for each color sub pixel, gamma values of various sub pixel groups are respectively regulated based on the difference curve. Thus, the foregoing drive method and device of a display panel are equivalent to dividing the display panel into a plurality of blocks (that is, sub pixel groups), and then individually and respectively regulating gamma values of the blocks. Since a scope of the drive voltage in each block is relatively small, simultaneous optimization of contrasts of brightness changing with the drive voltage at a front view angle and at a side view angle is easily realized, thereby embracing picture qualities at the front view angle and the side view angle, and improving display effect of the display panel.

BRIEF DESCRIPTION OF THE DRAWINGS

To illustrate the technical solutions according to the embodiments of the present invention or in the prior art more clearly, the accompanying drawings for describing the embodiments or the prior art are introduced briefly in the following. Apparently, the accompanying drawings in the following description are only some embodiments of the present invention, and persons of ordinary skill in the art can derive other drawings from the accompanying drawings without creative efforts.

DETAILED DESCRIPTION OF THE EMBODIMENTS

For ease of understanding, the following provides a more comprehensive description to this application with reference to the accompanying drawings. The accompanying drawings give embodiments of this application. However, this application can be implemented in many different forms, and is not limited to the embodiments described in this application. Rather, the objective of providing these embodiments is to make the understanding of disclosed content of this application more thorough and comprehensive.

Figure 1:
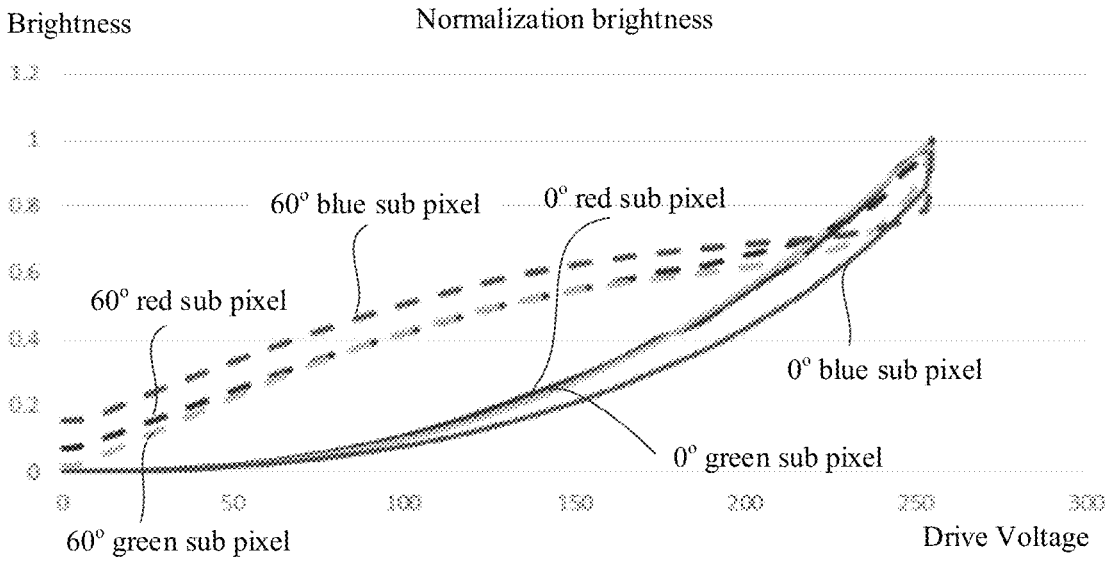
FIG. 1 is a diagram of a curve of brightness that is of a sub pixel and that changes with a drive voltage at a 0° angle and a 60° angle.
Figure 2:
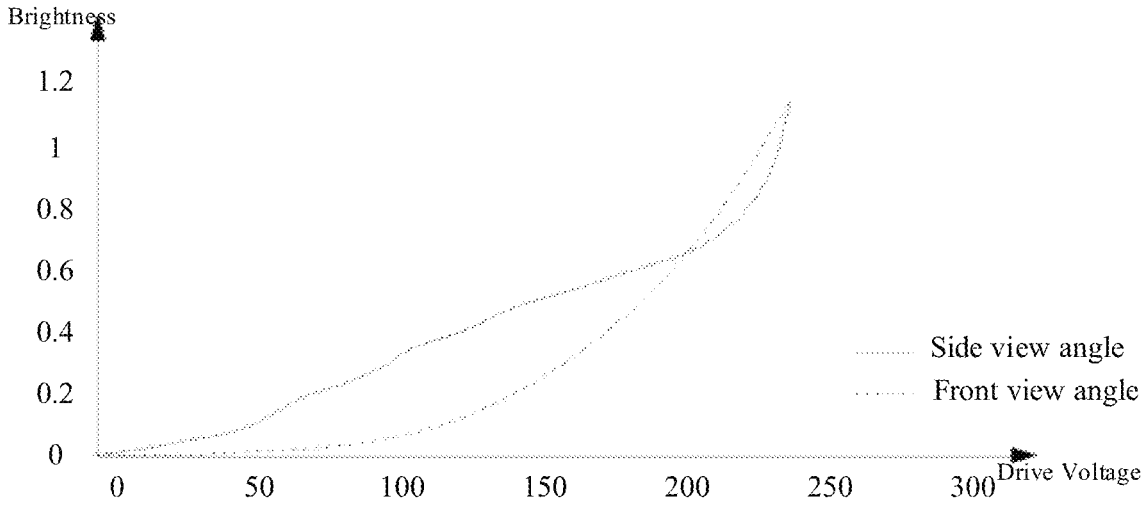
FIG. 2 is a diagram of a curve of brightness changing with a drive voltage at a front view angle and a side view angle after a gamma value is increased in an example.

FIG. 1 shows a curve of brightness that is of an exemplary VA type liquid crystal panel and that changes with a drive voltage, where a horizontal coordinate represents the drive voltage, a longitudinal coordinate represents brightness, a solid line represents a 0° curve, and an imaginary line represents a 60° curve. It can be seen from FIG. 1 that a trend of brightness saturation (that is, a curve tends to be flat) of various sub pixels at a 60° side view angle is rapidly increased. Especially under intermediate and low drive voltages, the brightness is rapidly saturated, and a contrast is decreased, so that an obvious washout phenomenon (that is, a picture is partial white, and the brightness cannot linearly change with the drive voltage) appears when a picture is watched at a mixed view angle. In order to overcome the aforementioned washout phenomenon, a solution of the example typically increases a gamma value. However, after the gamma value is increased, as shown in FIG. 2, although the brightness contrast of the intermediate and low drive voltages at a side view angle can be improved, a contrast brightness changing with the drive voltage at a front view angle and a brightness contrast of the high drive voltage at a side view angle are sacrificed, and an entire display effect of the display panel is still reduced.

Figure 3:
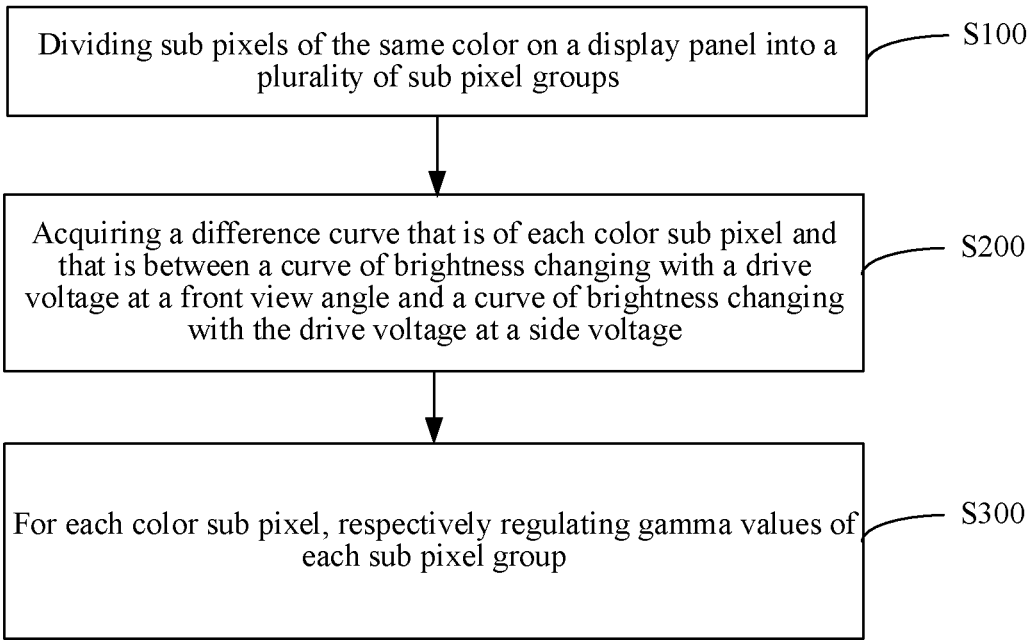
FIG. 3 a flowchart of a drive method of a display panel according to an implementation.

In order to resolve the problem that the entire display effect of the display panel is still reduced in a manner of increasing the gamma value, an implementation provides a drive method of a display panel. The method can be executed by a drive chip, and is used for driving the display panel to display corresponding pictures. The display panel may be a TN (Twisted Nematic), OCB (Optically Compensated Birefringence), or VA (Vertical Alignment) type liquid crystal display panel, or a curved surface type liquid display panel, but is not limited thereto. Referring to FIG. 3, the drive method of a display panel includes the following contents.

In Step S100, sub pixels of the same color on the display panel are divided into a plurality of sub pixel groups.

Dividing into a plurality of sub pixel groups is equivalent to partitioning the display panel. The display panel includes, for example, red sub pixels, blue sub pixels, and green sub pixels. Specifically, the red sub pixels on the display panel can be divided into a plurality of red sub pixel groups, the green sub pixels on the display panel can be divided into a plurality of green sub pixel groups, and the blue sub pixels on the display panel can be divided into a plurality of blue sub pixel groups.

Figure 4:
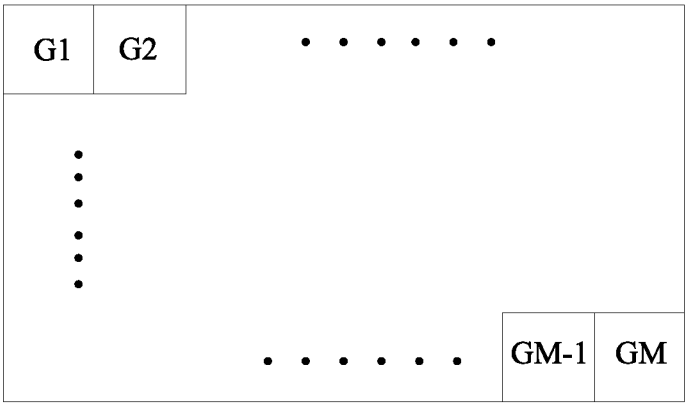
FIG. 4 is a schematic diagram of division of green sub pixels on a display panel according to an embodiment.
Figure 5:
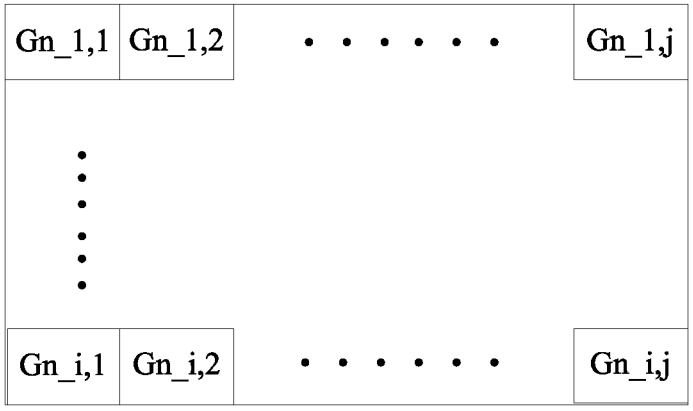
FIG. 5 is a schematic diagram of green sub pixel groups on the display panel according to an embodiment shown in FIG. 4.

Next, description is made by taking the green sub pixels as an example, and reference can be made to FIG. 4. All of the green sub pixels on the display panel are divided into M green sub pixel groups (G1, G2, . . . , GM) in total. Referring to FIG. 5, any green sub pixel group Gn (n=1, 2, . . . , or M) includes a plurality of green sub pixels (that is, Gn_1,1, Gn_1,2, . . . Gn_ij).

Thus, in this implementation, dividing the sub pixels on the display panel into a plurality of sub pixel groups facilitates a property that an independent signal processing process for each sub pixel group can effectively process brightness of local sub pixels. In addition, a larger quantity of sub pixel groups in the display panel indicates higher precision of the signal processing, therefore the quality of the displayed picture is better. The quantity into which the sub pixel groups are divided can be regulated based on actual situations, thereby enlarging an application scope of this method.

In Step S200, a difference curve that is of each color sub pixel and that is between a curve of brightness changing with a drive voltage at a front view angle and a curve of brightness changing with the drive voltage at a side view angle is acquired.

Figure 9:
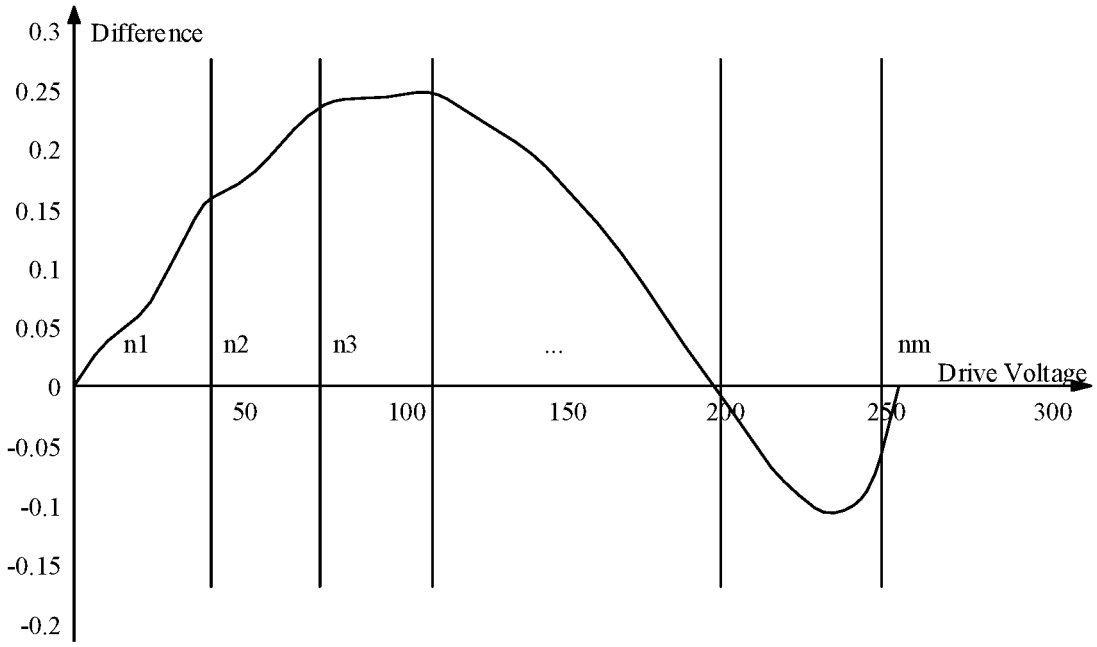
FIG. 9 is a schematic diagram of one of divisions of drive voltage intervals according to an embodiment shown in FIG. 8.

FIG. 9 provides a difference curve according to an embodiment. In this difference curve, a horizontal coordinate represents a drive voltage, and a longitudinal coordinate represents a difference value obtained by subtracting a brightness normalization value at a front view angle from a brightness normalization value at a side view angle. In addition, each color sub pixel has a corresponding difference curve.

In Step S300, for each color sub pixel, gamma values of various sub pixel groups are regulated respectively.

The gamma value represents a nonlinear relationship between the brightness and the drive voltage. In this step, the gamma values of various green sub pixel groups are respectively regulated based on the difference curve corresponding to the green sub pixels, the gamma values of various red sub pixel groups are respectively regulated based on the difference curve corresponding to the red sub pixels, and the gamma values of various blue sub pixel groups are respectively regulated based on the difference curve corresponding to the blue sub pixels. When the gamma values are different, situations that the brightness changing with the drive voltage are also different. This is described with examples below.

Figure 6:
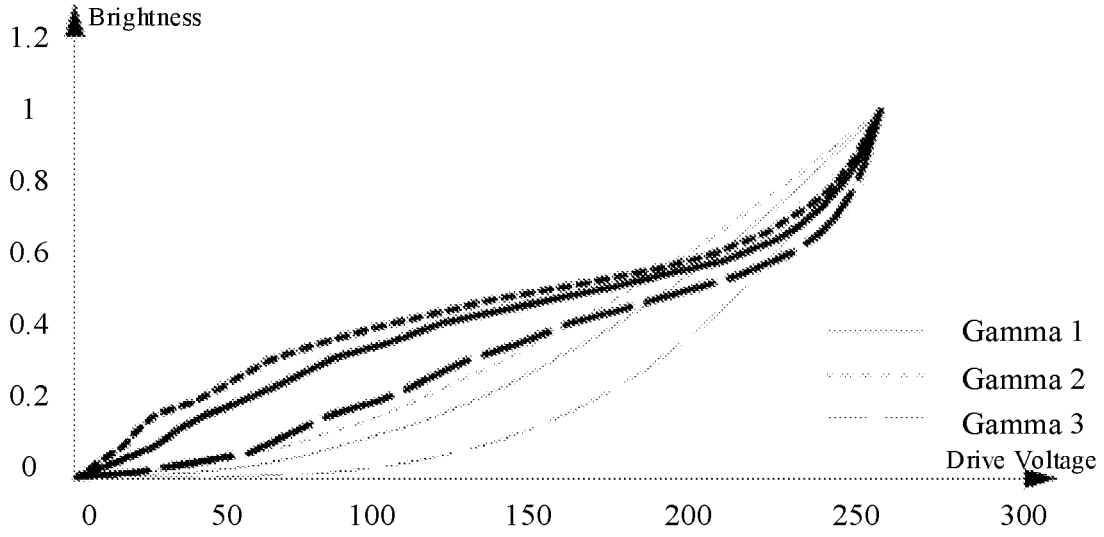
FIG. 6 is a schematic diagram of a curve of brightness that has different gamma values and that changes with a drive voltage at a front view angle and a side view angle according to an embodiment.
Figure 7:
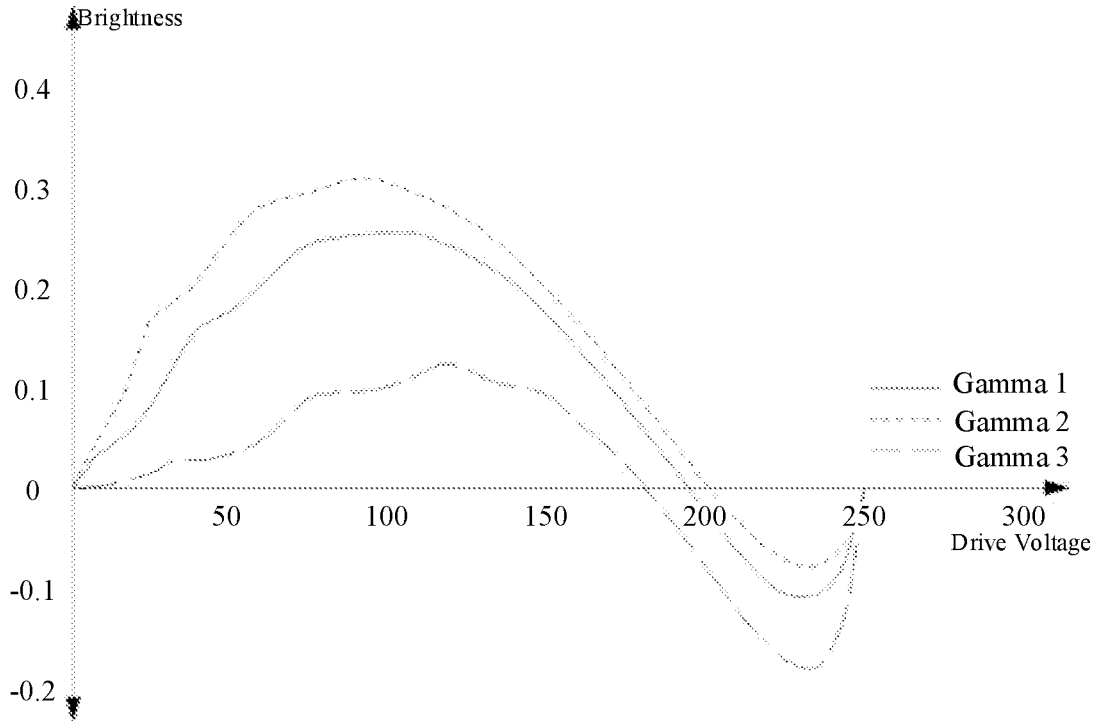
FIG. 7 is a schematic diagram of differences in brightness that has different gamma values and that changes with a drive voltage at a front view angle and a side view angle according to an embodiment shown in FIG. 6.

Referring to FIG. 6, a horizontal coordinate represents the drive voltage, and a longitudinal coordinate represents a normalized brightness value. When the gamma value is gamma 1, curves of brightness changing with the drive voltage at the front view angle and the side view angle respectively are a lower curve gamma 1 and an upper bold curve gamma 1, and differences in brightness changes at the front view angle and the side view angle are shown in FIG. 7. As shown, with increase of the drive voltage, the brightness at the side view angle is rapidly saturated with the drive voltage, especially, brightness corresponding to low and intermediate drive voltages is rapidly saturated, resulting in poor comparability of picture qualities at low and intermediate drive voltages.

If gamma 1 is increased, the gamma value is regulated from gamma 1 to gamma 3. In this way, the curves of brightness changing with the drive voltage at the front view angle and the side view angle respectively are a lower curve gamma 3 and an upper bold curve gamma 3 in FIG. 6, and differences in brightness changes at the front view angle and the side view angle are shown in FIG. 7. As shown, with increase of the drive voltage, a phenomenon that the brightness is rapidly saturated with the drive voltage at the side view angle is relieved, brightness changes corresponding to low and intermediate drive voltages close to a linear trend, thereby improving a comparability effect of picture qualities at the low and intermediate drive voltages. However, a linear trend of brightness changes corresponding to the low drive voltage at the front view angle may be sacrificed, so that a resolution between the drive voltages is reduced, and meanwhile a resolution between brightness corresponding to the high drive voltage at the side view angle is also reduced.

If gamma 1 is reduced, after the gamma value is regulated from gamma 1 to gamma 2, the curves of brightness changing with the drive voltage at the front view angle and the side view angle respectively are a lower curve gamma 2 and an upper bold curve gamma 2 in FIG. 6, and differences in brightness changes at the front view angle and the side view angle is shown in FIG. 7. As shown, with increase of the drive voltage, a phenomenon that the brightness is rapidly saturated with the drive voltage at the side view angle is aggravated, and comparability of picture qualities at the low and intermediate drive voltages is further reduced.

It can be seen from the above contents that since the gamma values are regulated as different values, observation effects at the front view angle and the side view angle can be simultaneously changed. However, if the gamma values of the display panel are uniformly regulated, the gamma value can be increased to relieve a phenomenon that brightness corresponding to the intermediate and the low drive voltages at the side view angle is rapidly saturated. However, since there are a relatively large quantity of drive voltages involved in the display panel, picture qualities corresponding to all drive voltage intervals cannot be simultaneously balanced. As a result, not only a contrast of brightness corresponding to the drive voltage at the front view angle is reduced, that is, the picture quality at the front view angle is sacrificed, but also a contrast of brightness changes corresponding to the high drive voltage at the side view angle is reduced. Therefore, in a manner of uniformly regulating the gamma values of the display panel, since there are a relatively large quantity of drive voltages involved, it is difficult to obtain a proper gamma value to balance the picture qualities at the front view angle and the side view angle at the same time. Thus, in order to overcome the aforementioned problem, in the present implementation, each gamma value corresponding to each sub pixel group is individually regulated, so that the gamma value is flexibly regulated as the gamma value suitable for each sub pixel group based on actual picture quality content of each sub pixel group. Therefore, finally trends that the brightness of various sub pixel groups changes with the drive voltage are different. Due to that there are relatively fewer drive voltages involved in each sub pixel group, picture qualities at the front view angle and the side view angle are easily embraced at the same time. In this way, trends of brightness changing with the drive voltage at the front view angle and the side view angle are both close to a linear change rule.

One manner of regulating the gamma value is that, for example: if the drive voltages of the sub pixel groups are mainly distributed in intermediate and low drive voltage intervals, the gamma value can be properly increased to improve the contrast of brightness corresponding to the intermediate and the low voltages at the side view angle; and meanwhile, an upper limit value of the gamma value is controlled to ensure the resolution of the brightness corresponding to the intermediate and the low drive voltages at the front view angle.

In addition, because the difference curve may reflect differences of brightness between the front view angle and the side view angle, and a smaller difference between the front view angle and the side view angle indicates a better display effect. Therefore, the gamma value is regulated based on the difference curve, and the gamma value is correspondingly regulated with respect to the differences between the front view angle and the side view angle at different drive voltage intervals, thereby facilitating reduction of the brightness differences between the front view angle and the side view angle.

Specifically, step S300 may be specifically: for each color sub pixel, respectively regulating gamma values of various sub pixel groups based on the difference curve, so that difference values between gamma values of corresponding curves of the side view angle and the front view angle of the whole display panel and 2.2 are all less than a set value (that is, close to 2.2). When the gamma value is 2.2, a linear change relationship between human eyes and the brightness is met, achieving a better display effect.

In summary, in the foregoing drive method of a display panel provided in this implementation, the display panel is divided into a plurality of blocks (that is, sub pixel groups), and then the gamma value of each block is respectively and individually regulated. Because a scope of the drive voltage involved in each block is relatively small, simultaneous optimization of the contrasts of brightness changing with the drive voltage at the front view angle and the side view angle is easily realized, thereby embracing the picture qualities at the front view angle and the side view angle, and improving the display effect of the display panel.

Figure 8:
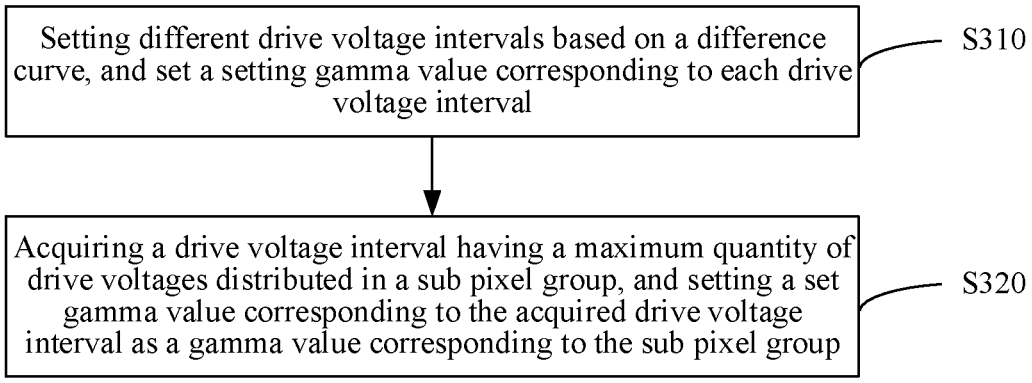
FIG. 8 is a flowchart of one of embodiments in step S300 in the drive method of a display panel according to the implementation shown in FIG. 3.

Specifically, referring to FIG. 8, the foregoing step S300 includes the following contents.

In Step S310, different drive voltage intervals are set based on the difference curve, and a set gamma values corresponding to each drive voltage interval is set.

The drive voltage interval is, for example, [n2, n3] in FIG. 9. Specifically, the quantity of the drive voltage intervals is larger than a set threshold. The set gamma value corresponding to each drive voltage interval, that is, the gamma value suitable for each drive voltage interval, can be set based on actual brightness of the drive voltage interval. For example, if a difference in the brightness between the side view angle and the front view angle in the drive voltage interval is relatively large, the gamma value can be set as a relatively large value; and if the difference in the brightness between the side view angle and the front view angle in the drive voltage interval is relatively small, the gamma value can be set as a relatively small value.

In Step S320, a drive voltage interval having a maximum quantity of drive voltages distributed in the sub pixel group is acquired, and a set gamma value corresponding to the acquired drive voltage interval is set as a gamma value corresponding to the sub pixel group.

Each sub pixel in the sub pixel group corresponds to one drive voltage, and thus the sub pixel group includes a plurality of drive voltages. The drive voltage interval having the maximum quantity of drive voltages distributed in the sub pixel group is acquired. In other words, a main distribution interval of the drive voltages of the sub pixel group is acquired. For example, if a proportion of the drive voltages in the sub pixel group is higher than X % (X % is, for example, between 60% and 100%) within one of the drive voltage intervals, it is considered that this drive voltage interval is a main distribution interval of the drive voltages of this sub pixel group. The set gamma value corresponding to the acquired drive voltage interval is set as the gamma value corresponding to the sub pixel group. In other words, the gamma value of the sub pixel group is regulated based on the mainly distributed drive voltage. For example, if the main distribution interval of the drive voltage of the sub pixel group is [n2, n3], the set gamma value corresponding to [n2, n3] is served as a regulated gamma value of this sub pixel group.

In addition, if the objective of optimizing the gamma value is to make the curves at the front view angle and the side view angle close to a curve whose gamma value is a set target value (for example 2.2), the quantity into which the drive voltage intervals are divided is larger the curves at the side view angle and the front side view are closer to the curve whose gamma value is the set target value (for example 2.2).

Figure 10:
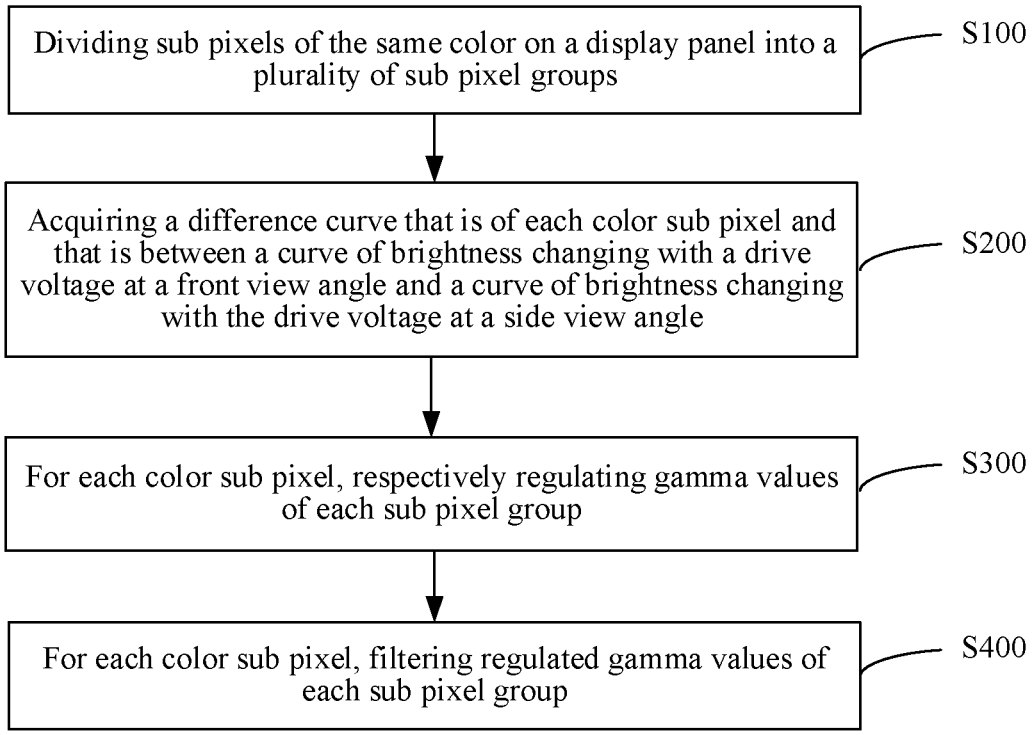
FIG. 10 is a flowchart of one of embodiments of the drive method of a display panel according to the implementation shown in FIG. 3.

In one of the embodiments, referring to FIG. 10, after step S300, the foregoing drive method of a display panel further includes the following contents.

In Step S400, for each color sub pixel, regulated gamma values of various sub pixel groups are filtered.

Because a difference exists in the main distribution intervals of drive voltages between the sub pixel groups, a corresponding difference also exists between the regulated gamma values of the sub pixel groups. Therefore, trends of brightness that is of various sub pixel groups and that changes with the drive voltage are different. The difference of brightness between adjacent sub pixel groups generates a macroscopic unsmooth transition boundary phenomenon at adjacent positions between two sub pixel groups. In order to resolve or relieve the above problem, in this embodiment, gamma values of various sub pixel groups on the display panel are further filtered after being regulated to eliminate the unsmooth transition phenomenon.

Figure 11:
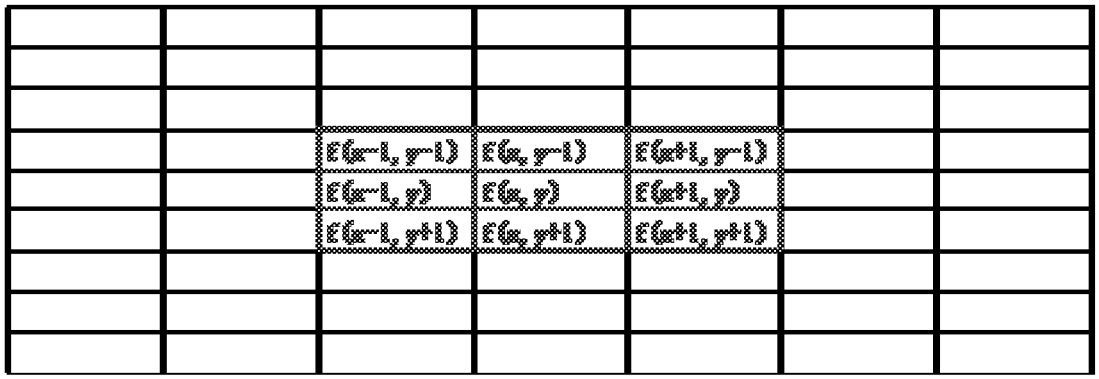
FIG. 11 is a schematic diagram of filtering involved in step S400 in the drive method of a display panel according to the embodiment shown in FIG. 10.

Specifically, the gamma values of various sub pixel groups can be filtered by using a spatial low pass filtering function. For example, referring to FIG. 11, taking the green sub pixels as an example, each box represents a green sub pixel group. All the green sub pixels on the display panel are divided into 9*7=63 groups of sub pixel groups. Taking a sub pixel group located in the middle as an example, when the gamma values of this sub pixel group are filtered, the following formula is adopted: $g(x,y)=w1*f(x-1,y-1)+w2*f(x-1,y)+w3*f(x-1,y+1)+w4*f(x,y-1)+w5*f(x,y)+w6*f(x,y+1)+w7*f(x+1,y-1)+w8*f(x+1,y)+w9*f(x+1,y+1)$.

f(x,y) represents a gamma value of the sub pixel group located in the middle prior to filtering. g(x,y) represents the gamma value of the sub pixel group located in the middle after filtering. f(x−1,y−1), f(x−1,y), . . . f(x+1,y+1) represent gamma values of various sub pixel groups surrounding the sub pixel group located in the middle. w1, w2, . . . w9 represent weights at various positions in the spatial low pass filtering function. The spatial low pass filtering function can effectively relieve the unsmooth transition phenomenon caused by difference in gamma values between the sub pixel groups.

It should be noted that FIG. 3, FIG. 8, and FIG. 10 are schematic flowcharts of the method according to the embodiments of this application. It should be understood that although steps in the flowcharts of FIG. 3, FIG. 8, and FIG. 10 are sequentially displayed according to instructions of arrows, these steps are not necessarily sequentially executed in a sequence indicated by the arrows. Otherwise explicitly stated herein, these steps are executed without a strict sequence restriction, and may be executed in other sequences. Moreover, at least some of the steps in FIG. 3, FIG. 8, and FIG. 10 may include a plurality of sub steps or a plurality of stages. These sub steps or stages are not necessarily completed at the same moment, but may be executed at different moments. The sub steps or stages may not be necessarily sequentially executed, but may be executed by turns or alternatively with other steps or sub steps of other steps or at least some of the stages.

Figure 12:
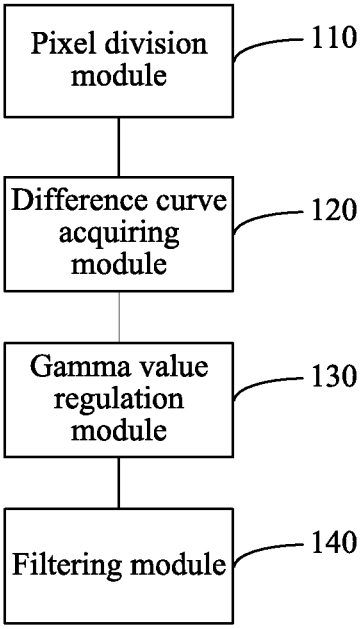
FIG. 12 is a block diagram of a drive device of a display panel according to another implementation.

Referring to FIG. 12, another implementation provides a drive device of a display panel, including:

a pixel division module 110, used to divide sub pixels of the same color on the display panel into a plurality of sub pixel groups;

a difference curve acquiring module 120, used to acquire a difference curve that is of each color sub pixel and that is between a curve of brightness changing with a drive voltage at a front view angle and a curve brightness changing with the drive voltage at a side view angle; and a gamma value regulation module 130, used to, for each color sub pixel, respectively regulate gamma values of various sub pixel groups based on the difference curve.

Figure 13:
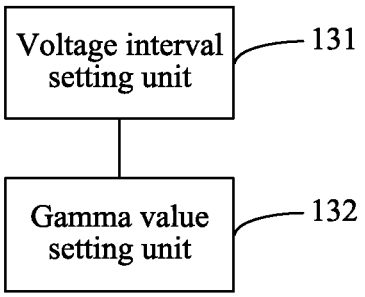
FIG. 13 is a block diagram of one of embodiments of a gamma value regulation module in the drive device of a display panel according to an implementation shown in FIG. 12.

In an embodiment, referring to FIG. 13, the gamma value regulation module 130 includes:

a voltage interval setting unit 131, used to set different drive voltage intervals based on the difference curve, and set a set gamma value corresponding to each drive voltage interval; and a gamma value setting unit 132, used to acquire the drive voltage interval having a maximum quantity of drive voltages distributed in the sub pixel group, and set a set gamma value corresponding to the acquired drive voltage interval as a gamma value corresponding to the sub pixel group.

In an embodiment, the quantity of the drive voltage intervals is larger than a set threshold.

In an embodiment, referring to FIG. 12 again, the drive device further includes:

a filtering module 140, used to, for each color sub pixel, filter regulated gamma values of various sub pixel groups.

It should be noted that the drive device of a display panel provided in this implementation corresponds to the drive method of a display panel according to the foregoing implementations, which is not described in detail herein again.

It should be noted that the drive device of a display panel provided in this implementation can be applied to a display device. The display device is, for example, an LCD (Liquid Crystal Display) display device, an OLED (Organic Light-Emitting Diode) display device, a QLED (Quantum Dot Light Emitting Diodes) display device, a curved surface display device, or other display devices.

The technical features of the foregoing embodiments may be freely combined. For a brief description, not all possible combinations of the technical features in the foregoing embodiments are described. However, the combinations of these technical features should be considered to fall within the scope of this specification as long as the combinations are not contradictory.

The foregoing embodiments only describe several implementations of this application, which are described specifically and in detail, and therefore cannot be construed as a limitation to the patent scope of the present invention. It should be noted that, a person of ordinary skill in the art may make various changes and improvements without departing from the ideas of this application, which shall all fall within the protection scope of this application. Therefore, the protection scope of the patent of this application shall be subject to the appended claims.

What is claimed is:

1. A drive method of a display panel, comprising:

dividing sub pixels of the same color on the display panel into a plurality of sub pixel groups;

acquiring a difference curve that is of each color sub pixel and that is between a curve of brightness changing with a drive voltage at a front view angle and a curve of brightness changing with the drive voltage at a side view angle; and for each color sub pixel, respectively regulating gamma values of various sub pixel groups based on the difference curve;

wherein the step of the respectively regulating gamma values of various the sub pixel groups based on the difference curve comprises:

setting different drive voltage intervals based on the difference curve, and setting a set gamma value corresponding to each drive voltage interval; and acquiring a drive voltage interval having a maximum quantity of drive voltages distributed in the sub pixel group, and setting a set gamma value corresponding to the acquired drive voltage interval as a gamma value corresponding to the sub pixel group.

2. The method according to claim 1, wherein the display panel comprises red sub pixels, blue sub pixels, and green sub pixels, and the step of the dividing sub pixels of the same color on the display panel into a plurality of sub pixel groups comprises:

dividing the red sub pixels on the display panel into a plurality of red sub pixel groups;

dividing the green sub pixels on the display panel into a plurality of green sub pixel groups; and dividing the blue sub pixels on the display panel into a plurality of blue sub pixel groups.

3. The method according to claim 2, wherein the step of the respectively regulating gamma values of various sub pixel groups based on the difference curve comprises:

respectively regulating the gamma values of various green sub pixel groups based on the difference curve corresponding to the green sub pixels;

respectively regulating the gamma values of various red sub pixel groups based on the difference curve corresponding to the red sub pixels; and respectively regulating the gamma values of various blue sub pixel groups based on the difference curve corresponding to the blue sub pixels.

4. The method according to claim 1, wherein for the difference curve, a horizontal coordinate represents a drive voltage, and a longitudinal coordinate represents a difference value obtained by subtracting a brightness normalization value at a front view angle from a brightness normalization value at a side view angle.

5. The method according to claim 1, wherein the quantity of the drive voltage intervals is larger than a set threshold.

6. The method according to claim 1, wherein the set gamma value is set based on brightness of the drive voltage interval.

7. The method according to claim 1, wherein the step of the acquiring the drive voltage interval having a maximum quantity of drive voltages distributed in the sub pixel group comprises:

acquiring a first drive voltage interval among the drive voltage intervals, a proportion of the drive voltages in the sub pixel group being higher than a preset value within the first drive voltage intervals, and determining the first drive voltage interval as the drive voltage interval having the maximum quantity of drive voltages distributed in the sub pixel group.

8. The method according to claim 1, wherein after the step of the for each color sub pixel, respectively regulating gamma values of various sub pixel groups based on the difference curve, the method further comprising:

for each color sub pixel, filtering regulated gamma values of various sub pixel groups.

9. The method according to claim 8, wherein for each color sub pixel, the regulated gamma values of various sub pixel groups are filtered by using a spatial low pass filtering function.

10. A drive device of a display panel, comprising one or more processors, a memory and one or more programs stored on the memory, wherein when the one or more programs are executed by the one or more processors, the drive device is caused to:

divide sub pixels of the same color on the display panel into a plurality of sub pixel groups;

acquire a difference curve that is of each color sub pixel and that is between a curve of brightness changing with a drive voltage at a front view angle and a curve of brightness changing with the drive voltage at a side view angle;

regulate gamma values of various sub pixel groups based on the difference curve for each color sub pixel respectively;

set different voltage intervals based on the difference curve, and set a set gamma value corresponding to each drive voltage interval; and acquire the drive voltage interval having a maximum quantity of drive voltages distributed in the sub pixel group, and set a set gamma value corresponding to the acquired drive voltage interval as a gamma value corresponding to the sub pixel group.

11. The drive device according to claim 10, wherein the display panel comprises red sub pixels, blue sub pixels, and green sub pixels, and when the one or more programs are executed by the one or more processors, the drive device is further caused to:

divide the red sub pixels on the display panel into a plurality of red sub pixel groups;

divide the green sub pixels on the display panel into a plurality of green sub pixel groups; and divide the blue sub pixels on the display panel into a plurality of blue sub pixel groups.

12. The drive device according to claim 11, wherein when the one or more programs are executed by the one or more processors, the drive device is further caused to:

respectively regulate the gamma values of various green sub pixel groups based on the difference curve corresponding to the green sub pixels;

respectively regulate the gamma values of various red sub pixel groups based on the difference curve corresponding to the red sub pixels; and respectively regulate the gamma values of various blue sub pixel groups based on the difference curve corresponding to the blue sub pixels.

13. The drive device according to claim 10, wherein for the difference curve, a horizontal coordinate represents a drive voltage, and a longitudinal coordinate represents a difference value obtained by subtracting a brightness normalization value at a front view angle from a brightness normalization value at a side view angle.

14. The drive device according to claim 10, wherein the quantity of the drive voltage intervals is larger than a set threshold.

15. The drive device according to claim 10, wherein the set gamma value is set based on brightness of the drive voltage interval.

16. The drive device according to claim 10, when the one or more programs are executed by the one or more processors, the drive device is further caused to:

filter regulated gamma values of various sub pixel groups for each color sub pixel.

17. A drive method of a display panel, comprising:

dividing sub pixels of the same color on the display panel into a plurality of sub pixel groups;

acquiring a difference curve that is of each color sub pixel and that is between a curve of brightness changing with a drive voltage at a front view angle and a curve of brightness changing with the drive voltage at a side view angle;

for each color sub pixel, setting different drive voltage intervals based on the difference curves and setting a set gamma value corresponding to each drive voltage interval, acquiring the drive voltage interval having a maximum quantity of drive voltages distributed in the sub pixel group, and setting a set gamma value corresponding to the acquired drive voltage interval as a gamma value corresponding to the sub pixel group; and for each color sub pixel, filtering regulated gamma values of various sub pixel groups.

* * * * *